US008221167B2

(12) United States Patent
Kuo et al.

(10) Patent No.: US 8,221,167 B2
(45) Date of Patent: Jul. 17, 2012

(54) ELECTRICAL CONNECTOR

(75) Inventors: Peter Kuo, Tu-Cheng (TW); Chin-Pao Kuo, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/964,725

(22) Filed: Dec. 9, 2010

(65) Prior Publication Data

US 2011/0143600 A1 Jun. 16, 2011

(51) Int. Cl.
*H01R 24/00* (2006.01)

(52) U.S. Cl. ..... 439/660

(58) Field of Classification Search ..... 439/660, 439/676, 857, 224, 852, 68
See application file for complete search history.

(56) References Cited

U.S. PATENT DOCUMENTS

| | | | | |
|---|---|---|---|---|
| 5,833,500 | A * | 11/1998 | Mahon et al. | 439/852 |
| 6,171,126 | B1 * | 1/2001 | Wu et al. | 439/224 |
| 7,056,146 | B2 | 6/2006 | Hiramoto et al. | |
| 7,070,465 | B2 * | 7/2006 | Masaki et al. | 439/850 |
| 2003/0236025 | A1 * | 12/2003 | Wu | 439/495 |
| 2006/0073742 | A1 * | 4/2006 | Cisey | 439/857 |
| 2007/0042649 | A1 * | 2/2007 | Russelburg | 439/857 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector, comprising an insulative housing defining a base portion and a mating portion extending from the front side of the base portion along a mating direction; a plurality of passageways disposed in the base portion and extending along the mating direction; a plurality of receiving spaces disposed in the mating portion and communicating with the complementary passageways; a plurality of contacts assembling to the insulative housing along the mating direction, and each contact defining a flat base part mounting to the base portion of the insulative housing and a mating part extending from the base part forwards from the base part and into said receiving space; wherein a spring tab extending downwards from the base part of the contact and locked to the insulative housing.

20 Claims, 6 Drawing Sheets

ELECTRICAL CONNECTOR

BACKGROUND OF THE INVENTION

1. Field of the Invention

The present invention relates generally to an electrical connector, and more particularly to electrical connector with special contacts. This application relates to a copending application claiming priority of TW 98223186 filed Dec. 11, 2009 and having the same title, the same applicants and the same assignee with the instant invention.

2. Description of the Prior Art

A connector to be attached to an insulated wire defines a resin housing and a contact (terminal metal fitting) secured to the housing. An IDC contact is featured with a slot in which when a conductive wire is disposed within the slot, insulative jacket of the conductive wire be pierced through by edges of the slot. As a result, not only will the conductive wire be held therein, electrical interconnection between the IDC contact and the conductor within the wire is also established. When such an insulation displacement contact is used, the contact and the core wire portion of the insulated wire can be electrically connected to each other merely by pushing the insulated wire into the slot of the insulation displacement contact. A connector using such an insulation displacement contact is called an insulation displacement connector. U.S. Pat. No. 7,056,146 issued to Hiramoto on Jun. 6, 2006 discloses a connector utilizing the IDC contact terminal which is arranged such that the conductive wires is in alignment with the mating direction, see FIGS. 1, 4 and 8. According to the disclosure, the diameter of the conductive wire is limited while the length of the slot is fixed, besides, the kind of contacts usually defines a very small size. Obviously, it requires more precision in the manufacturing process and it's difficult for the producer to manufacture exactly.

Hence, in this art, a contact to overcome the above-mentioned disadvantages of the prior art should be provided.

BRIEF SUMMARY OF THE INVENTION

A primary object, therefore, of the present invention is to provide an electrical connector, which defines contacts soldering with cables.

In order to implement the above object, an electrical connector comprising an insulative housing defining a base portion and a mating portion extending from the front side of the base portion along a mating direction; a plurality of passageways disposed in the base portion and extending along the mating direction; a plurality of receiving spaces disposed in the mating portion and communicating with the complementary passageways; a plurality of contacts assembling to the insulative housing along the mating direction, and each contact defining a flat base part mounting to the base portion of the insulative housing and a mating part extending from the base part forwards from the base part and into said receiving space; wherein a spring tab extending downwards from the base part of the contact and locked to the insulative housing.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
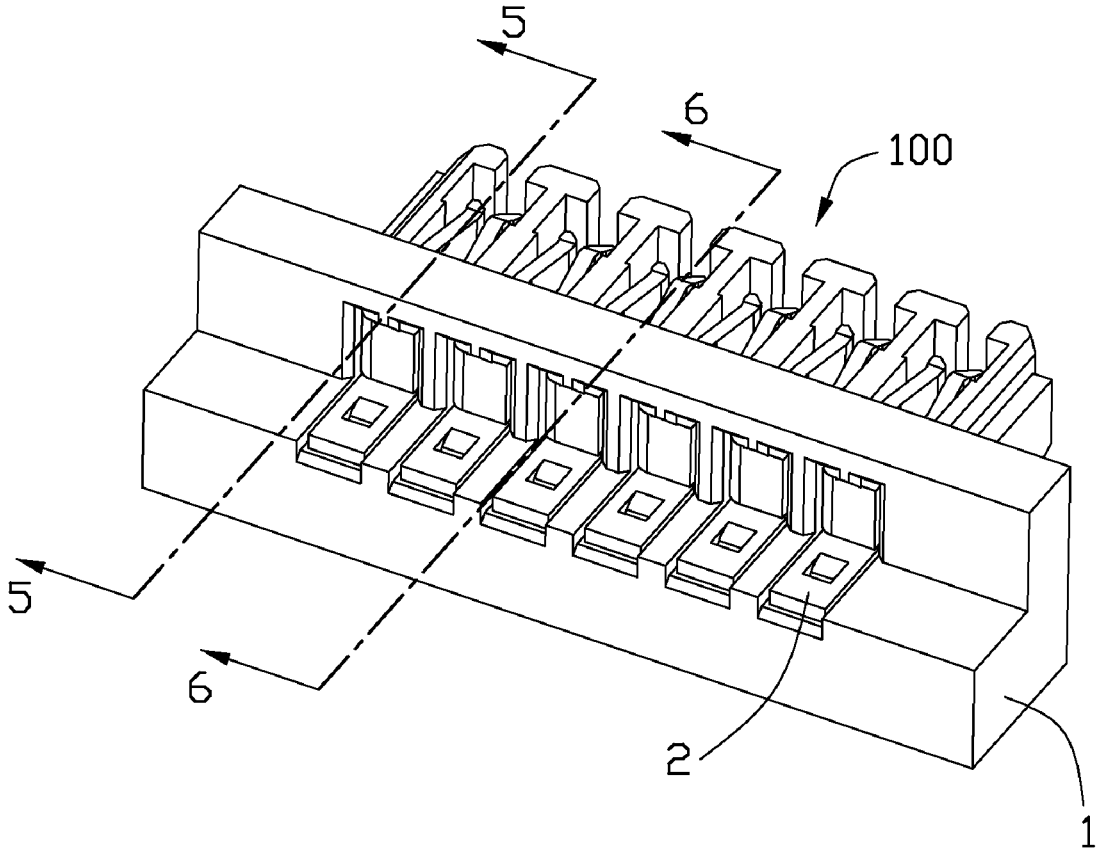
FIG. 1 is a perspective view illustrating a preferred embodiment of an electrical connector in according with the present invention.
Figure 2:
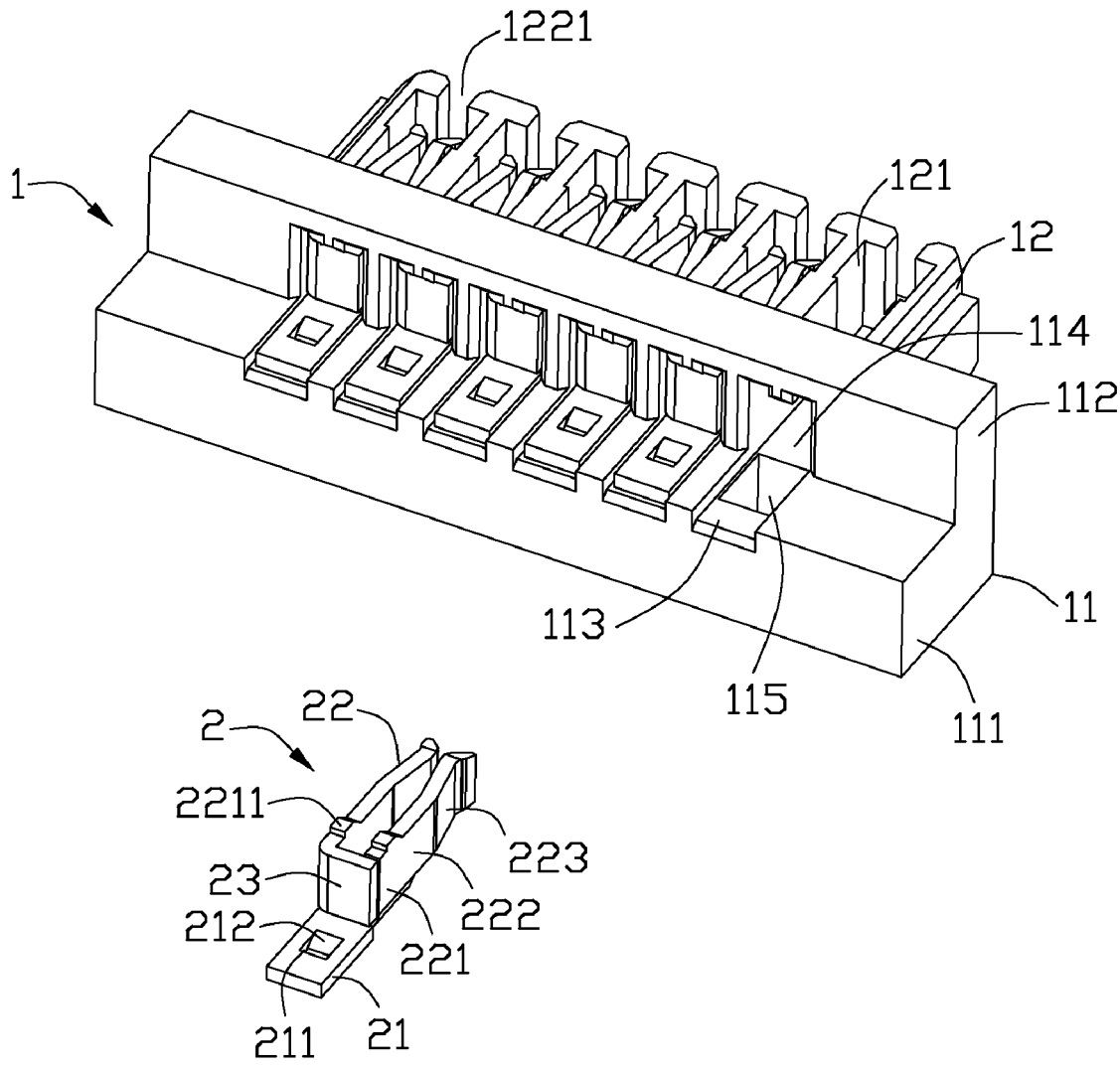
FIG. 2 is a perspective view of FIG. 1, but one contact separated from the electrical connector.
Figure 3:
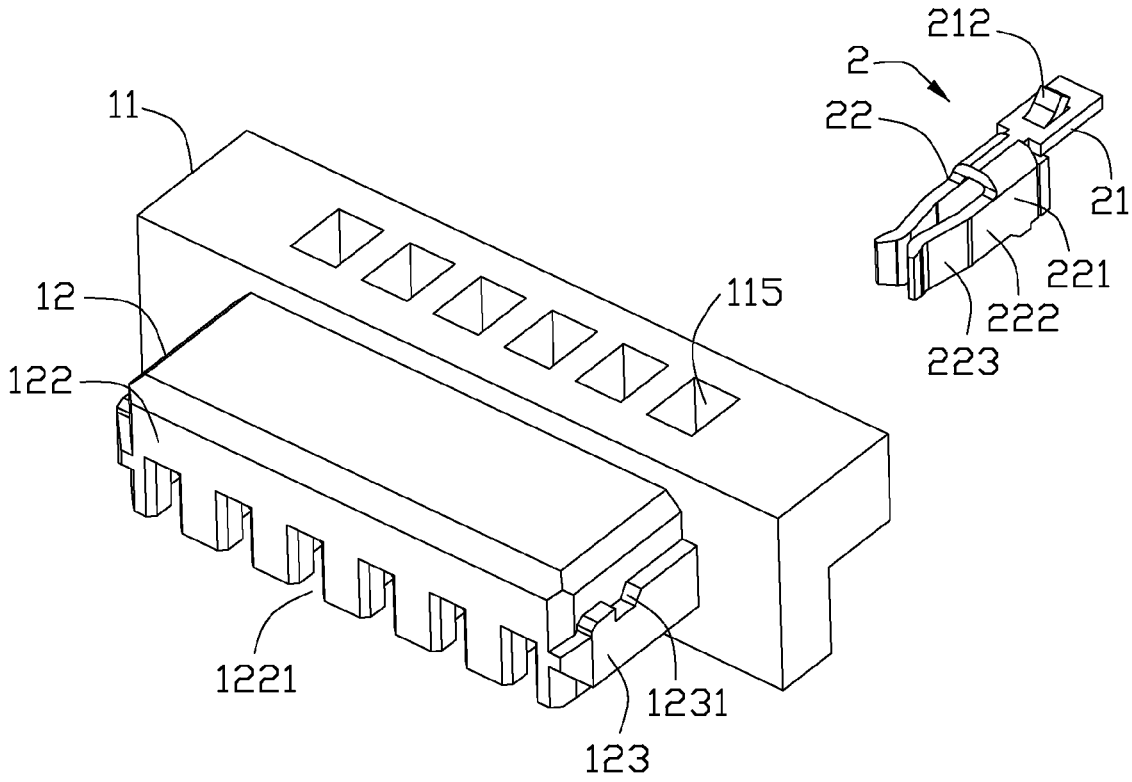
FIG. 3 is a view similar to FIG. 2, but viewed from another angle.
Figure 4:
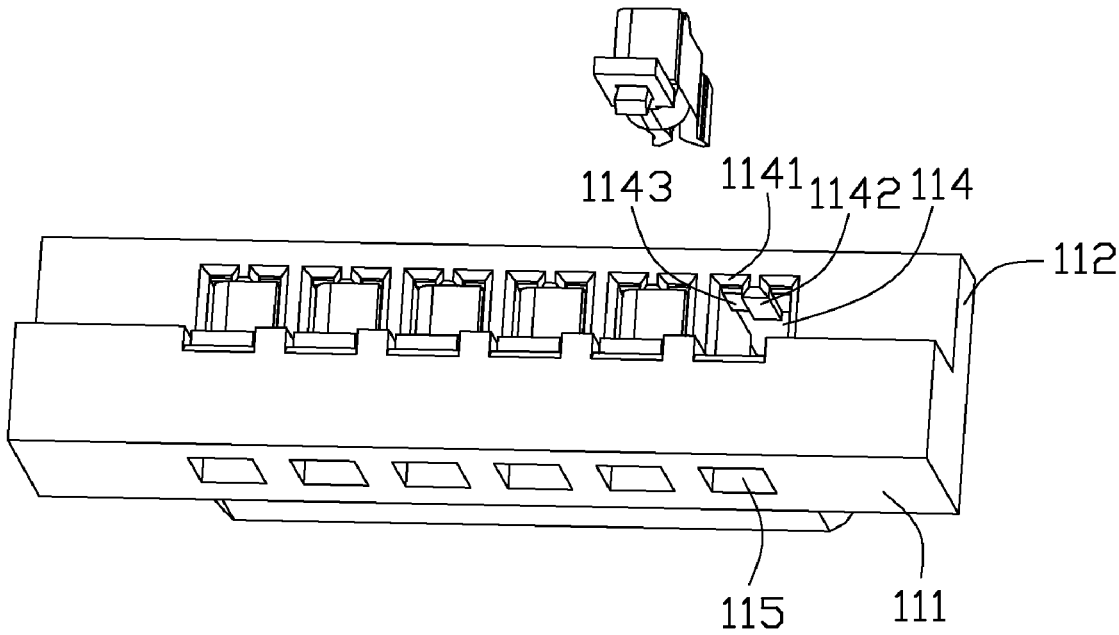
FIG. 4 is a view similar to FIG. 2, but viewed from another angle.
Figure 5:
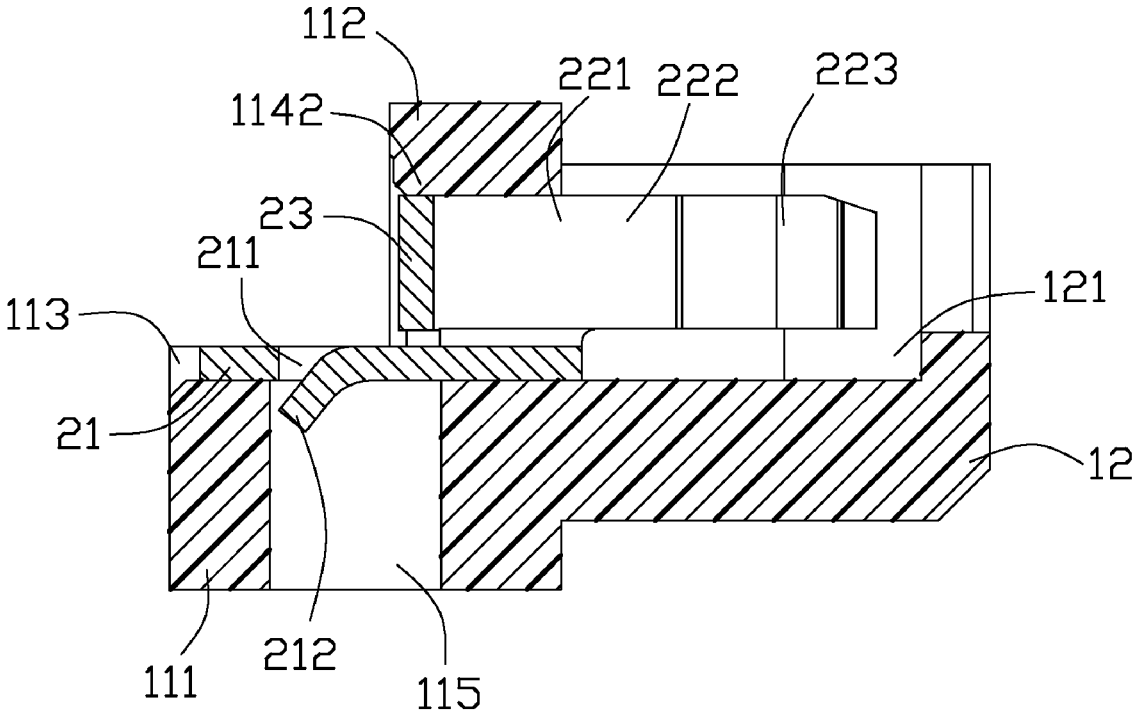
FIG. 5 is a section view illustrating the contact and the housing fitted to each other along 5-5 line.
Figure 6:
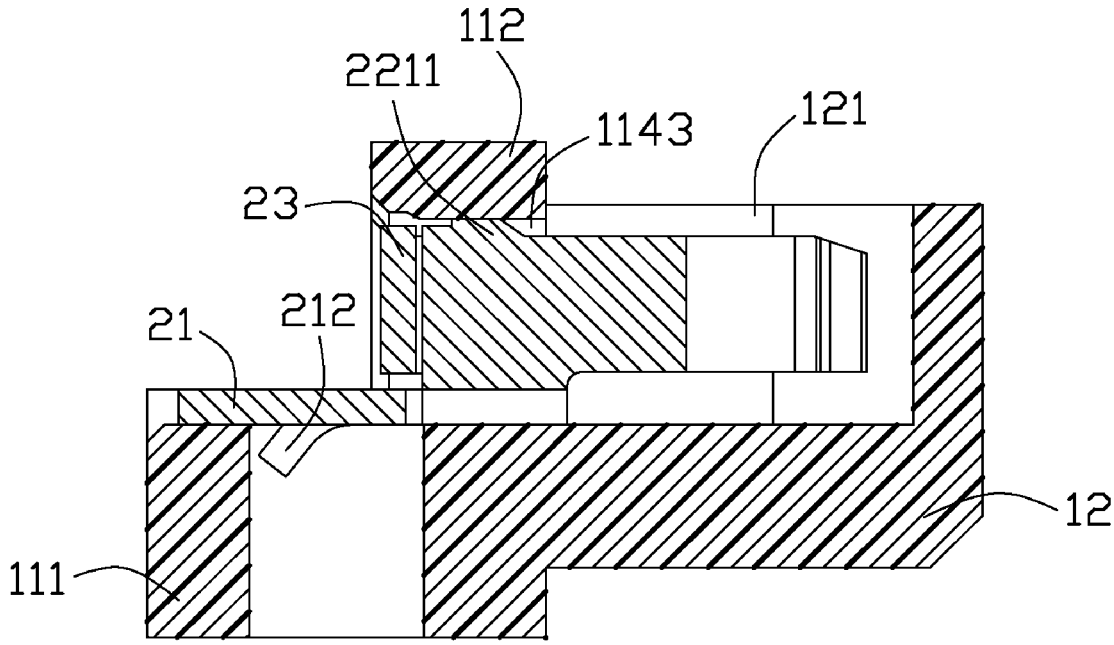
FIG. 6 is a section view illustrating the contact and the housing fitted to each other along 6-6 line.

Reference to FIGS. 1 to 6, an electrical connector 100 in according with a preferred embodiment of the present invention is shown. The electrical connector 100 comprises an insulative housing 1 and a row of contacts 2 received in the housing 1.

The insulative housing 1 includes a base portion 11 and a mating portion 12 extending from the front side of the base portion 11 along a mating direction. In this embodiment, the mating direction is from back to front. The base portion 11 has an L-shaped configuration in a side view and defines a first base 111 and a second base 112 vertically linking to the first base 111. The first base 111 defines a top face with a row of channels 113 for contacts 2, and a plurality of slots 115 going through the first base 111 along a direction vertical to the mating direction and communicating with the complementary channels 113. The second base 112 defines a row of passageways 114 extending along the mating direction and communicating with the complementary channels 113. Each of the passageways 114 defines an opening backwards and defines a top wall 1141 and a pair of side walls. A convex rib 1142 is disposed on the inner side of the top wall 1141 and extending along the mating direction. The rib 1142 and the pair of side walls together forms a pair of grooves 1143.

The mating portion 12 defines a plurality of receiving spaces 121 communicating with the complementary passageways 114 for the contacts 2 receiving in. Each of the receiving spaces 121 is opening upwards. The mating portion 12 defines a front wall 122 with a plurality of outlets 1221 communicating with the receiving spaces 121 for the contacts of the complementary connector inserting in. The mating portion 12 further defines a pair of guiding arms 123 disposed on the two sides of the mating portion 2 and extending along the mating direction. A notch 1231 is disposed on each guiding arm 123 for locking with the complementary connector and avoiding inserting in a wrong direction.

Reference to FIGS. 2 to 6, The contact 2 is made from electric material stamped from sheet metal and defines a flat base part 21 for soldering cables, a mating part 22 extending forwards from the base part 21, and a spacer part 23 locating between the base part 21 and the mating part 22. The base part 21 is disposed in the channel 113 of the insulative housing 1. A rectangular hole 211 is disposed on the base part 21, and a spring tab 212 extends from the front edge of the hole 211 slantways and backwards into the slot 115 of the insulative housing 1. The spring tab 212 retained in the insulative housing 1 is used for ensuring the contact 2 stably retained with the insulative housing 1 and providing a large area for soldering wires.

The mating part 22 defines a pair of vertical arms 221 extending upwards from the base part 21 along a direction vertical to the base part 21, a pair of connecting arms 222 extending forwards from the vertical arms 221 along the mating direction and a pair of curved touching arms 223 extending forwards from the connecting arms 222. The pair of touching arms 223 extend along a direction close to each other firstly and then extend along a direction away from each other, and the pair of touching arms 223 has a closest distance which could just allow the complementary contact inserting in. The pair of vertical arms 221 are retained in the passageway 114 of the insulative housing 1 with the rib 1142 locating between the two vertical arms 221. A wedge tab 2211 protruded from each vertical arm 221 is posted in the groove 1143 of the insulative housing 1 and retained by the rib 1142. The wedge tab 2211 is used for preventing the contact 2 shaking in the left and right direction and posting the contacts 2 in the passageway 114 in the up and down direction. The width and the height of the contact 2 is similar with the passageways 114 of the insulative housing 1.

The spacer part 23 of the contact 2 is a rectangular plate and extends from the back edge of one of the vertical arms 221 to the other vertical arm 221. The spacer part 23 is received in the passageway 114 and located under the rib 1142. The spacer part 23 defines a similar size with the passageway 114 and covers the opening of the passageway 114 so as to preventing the solder during the soldering process and the material during the molding process flowing into the passageways 114 and the receiving space 121 and damaging the mating part 22 of the contact 2.

In assembly, firstly a row of contacts 2 are inserted into the receiving space 121 through the passageways 114 in the mating direction. Secondly, use glue to retain the base part 21 of the contact 2 in the first base 111 of the insulative housing 1. Thirdly, make the cable solder on the spring tab 212 of the base part 21. According to the present invention, the diameter of the cable may not be limited because the cable is soldered on the contact 2. It is easy to manufacture the contact 2 for the producer.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector, comprising:

an insulative housing defining a base portion and a mating portion extending from the front side of the base portion along a mating direction;

a plurality of passageways disposed in the base portion and extending along the mating direction;

a plurality of receiving spaces disposed in the mating portion and communicating with the complementary passageways;

a plurality of contacts assembled to the insulative housing along the mating direction, and each contact defining a flat base part mounting to the base portion of the insualtive housing and a mating part extending from the base part forwards from the base part and into said receiving space; wherein a spring tab extending downwards from the base part of the contact and locked to the insulative housing; wherein said contact deeply defines a spacer part located between the base part and the mating part of the contact and mounted to the insulative housing.

2. The electrical connector as claimed in claim 1, wherein said base part of the contact defines a rectangle hole, and said spring tab extends slantways and backwards from the front edge of the hole.

3. The electrical connector as claimed in claim 2, wherein said base portion of the insulative housing defines an L-shaped configuration in a side view and defines a first part and a second part vertically connected to the first part.

4. The electrical connector as claimed in claim 3, wherein said first part of the insulative housing defines a plurality of rectangular slots receiving the base part of the contact, said passageways are disposed in the second part of the insulative housing and arranged in a row along the horizontal direction.

5. The electrical connector as claimed in claim 3, wherein said first base defines a row of rectangular slots through the first base along the up and down direction for retaining said spring tab of the contact.

6. The electrical connector as claimed in claim 3, wherein said mating part of the contact defines a pair of vertical arms extending upwards and vertically from the base part of the contact, a pair of connecting arms extending forwards from the vertical arms along the mating direction and a pair of curved touching arms extending forwards from the connecting arms.

7. The electrical connector as claimed in claim 6, wherein said spacer part is mounted to the second base of the insulative housing.

8. The electrical connector as claimed in claim 6, wherein said spacer part is a rectangular metal plate extending from the back edge of one of the vertical arm to the other vertical arm along a direction vertical to the vertical arms.

9. The electrical connector as claimed in claim 6, wherein said vertical arms of the contacts are disposed in the passageways of the insulative housing.

10. The electrical connector as claimed in claim 9, wherein said each passageway extends along the mating direction and defines a top wall and two side walls, a rib is disposed on the inner side of the top wall and extends along the mating direction.

11. The electrical connector as claimed in claim 10, wherein said top wall, two side walls and the rib together form two grooves, and each vertical arm of the contact defines a wedge tab protruding upwards from the top side of the vertical arm and extending into the groove.

12. The electrical connector as claimed in claim 11, wherein said spacer part of the contact is received in the back portion of the passageway and connecting to the rib.

13. An electrical connector comprising:

an insulative housing defining a base portion and a mating portion forwardly extending from the base portion, said base portion defining an L-shaped cross-section and having a front vertical base from which said mating portion extends, and rear horizontal base;

a plurality of passageways formed in the front vertical base of the base portion along a front-to-back direction;

a plurality of receiving spaces formed in the mating portion along said front-to-back direction and in alignment with the corresponding passageways, respectively;

a plurality of slots formed in the rear horizontal base of the base portion, initially exposed to an exterior in a vertical direction, and in alignment with the corresponding passageways, respectively;

a plurality of contacts disposed in the corresponding passageways, respectively, each of said contacts defining a front mating section disposed in the corresponding receiving space, and a rear base part mounted upon the horizontal base and covering the corresponding slot and exposed vertically for soldering to a corresponding wire; wherein said base part of the contact is equipped with a retention structure for retaining into the slots of the rear horizontal base.

14. The electrical connector as claimed in claim 13, wherein each of said contacts is equipped with another retention structure for retaining to the front vertical base.

15. The electrical connector as claimed in claim 13, wherein said rear horizontal base is equipped with a plurality of channels in alignment with the corresponding passageways, respectively, to receive the rear base part of the corresponding contact.

16. The electrical connector as claimed in claim 13, wherein each of said contacts includes a spacer part forwardly shielding the corresponding passageway for avoiding contamination after the corresponding contact is fully assembled into the housing.

17. The electrical connector as claimed in claim 13, wherein each of said passageways defines a top wall and two side walls, and a rib is disposed on an inner side of the top wall and extends along the front-to-back direction.

18. An electrical connector comprising:

an insulative housing defining a base portion and a mating portion forwardly extending from the base portion, said base portion defining an L-shaped cross-section and having a front vertical base from which said mating portion extends, and a rear horizontal base;

a plurality of passageways formed in the front vertical base of the base portion along a front-to-back direction;

a plurality of receiving spaces formed in the mating portion along said front-to-back direction and in alignment with the corresponding passageways, respectively;

a plurality of contacts disposed in the corresponding passageways, respectively, each of said contacts defining a front mating section disposed in the corresponding receiving space, and a rear base part mounted upon the horizontal base and exposed vertically for soldering to a corresponding wire;

wherein each of the contacts includes barbs in the corresponding passageway for retaining to the front vertical base, and a spring tab extending into a slot in the rear horizontal base for retaining thereto.

19. The electrical connector as claimed in claim 18, wherein each of said contacts includes a spacer part forwardly shielding the corresponding passageway for avoiding contamination after the corresponding contact is fully assembled into the housing.

20. The electrical connector as claimed in claim 18, wherein each of said passageways defines a top wall and two side walls, and a rib is disposed on an inner side of the top wall and extends along the front-to-back direction.

* * * * *